United States Patent [19]

Horsewell et al.

[11] 4,033,361

[45] July 5, 1977

[54] TOBACCO-SMOKE FILTERS

[75] Inventors: Henry George Horsewell, Totton; Ian Richard Harris, Alton, both of England

[73] Assignee: Brown & Williamson Tobacco Corporation, Louisville, Ky.

[22] Filed: June 11, 1975

[21] Appl. No.: 585,983

[30] Foreign Application Priority Data

June 17, 1974 United Kingdom ..... 26780/74

[52] U.S. Cl. ..... 131/262 A; 131/10 R

[51] Int. Cl.[2] ..... A24D 1/06

[58] Field of Search ..... 131/262 A, 269

[56] References Cited

UNITED STATES PATENTS

| | | | |
|---|---|---|---|
| 2,800,908 | 7/1957 | Blank et al. | 131/262 A |
| 3,658,069 | 4/1972 | Wise et al. | 131/10.7 X |

FOREIGN PATENTS OR APPLICATIONS

| | | | |
|---|---|---|---|
| 80,960 | 3/1956 | Netherlands | 131/262 A |
| 1,023,918 | 3/1966 | United Kingdom | 131/262 A |
| 878,457 | 7/1961 | United Kingdom | 131/262 A |

*Primary Examiner*—Robert W. Michell
*Assistant Examiner*—V. Millin
*Attorney, Agent, or Firm*—William J. Mason

[57] ABSTRACT

A tobacco-smoke filter contains, as adsorbent for volatile tobacco-smoke constituents, a macroporous amine-type anion-exchange resin which contains substantially primary amino groups only, for instance a cross-linked polyvinyl aromatic compound such as polystyrene cross-linked with divinyl benzene. Advantageously the resin is used in particulate form between fibrous, filamentary or paper filter sections or dispersed in tow. The resin may be half-neutralised with acetic acid or admixed with solid acid.

12 Claims, No Drawings

TOBACCO-SMOKE FILTERS

This invention concerns improvements relating to tobacco smoke filters.

Filters made from filamentary or fibrous material such as cellulose acetate tow or paper remove the particulate phase of tobacco smoke by mechanical means. Tobacco smoke also contains certain components in the vapour phase such as aldehydes, cyanides and sulphides. These volatile constituents can be removed by adsorption or absorption on a suitable surface or by chemical reaction.

Substances which act as absorbents or adsorbents include activated carbon, porous minerals such as meerschaum and cation and anion-exchange resins. Weakly basic anion-exchange resins of porous structure are particularly suitable, but their efficiency diminishes during smoking, as does that of carbon and porous minerals. This may be due to the material becoming saturated and, therefore, increasingly inactive or due to release of adsorbed material by thermal desorption of retained substances.

According to the present invention, a tobacco-smoke filter contains, as adsorbent for volatile tobacco-smoke constituents and particularly for the aldehydes, a macroporous amine-type anion-exchange resin which contains substantially primary amino groups only. A particularly efficient such macroporous resin is a cross-linked polyvinyl aromatic compound such as a polystyrene cross-linked with divinyl benzene.

A tobacco-smoke filter containing a resin of the aforesaid kind is not only effective in removing volatile constituents, but also retains a high degree of effectiveness throughout the smoking of a cigarette provided with the filter. Furthermore, the filter mainly removes aliphatic aldehydes, a particularly desirable effect.

In the Offenlegungschrift of German Patent Application No. 2,332,103 (Bayer A.G.), it has been proposed that, in a process for the removal of oleophilic odorous and taste substances from water by treatment with an insoluble macroporous absorbent resin, the resin, consisting of a matrix based on an organic polymer containing linked aromatic nuclei, should have, as substituents, chloromethyl groups whose chlorine may be a mixed polymer of styrene and divinyl benzene.

The anion-exchange resin used for the purposes of the present invention is of a similar nature, but contains, substantially, primary amino groups only obtained by substitution of the chloromethyl groups with ammonia, not with other amines. This resin is effective in removing volatile constituents such as aldehydes, and particularly the aldehydes, from cigarette smoke.

United Kingdom Patent Specification No. 1,133,920 claims a process, for producing a macroporous anion-exchange resin containing secondary or tertiary amino groups, which comprises reacting a chloromethylated cross-linked copolymer, for example a copolymer of styrene, and divinyl benzene.

Resins which contain major proportions of tertiary amino or quaternary ammonium groups are not suitable for removing aldehydes from tobacco smoke. Even resins containing an appreciable proportion of the secondary groups are less suitable than those containing substantially only the primary groups. The primary amino groups are chemically bonded to the resin and amine is, therefore, less likely to transfer to the tobacco smoke. Consequently the resin remains effective for a longer period of smoking. When amines or amine salts are added as such to smoke-filtering materials, transfer of amines can occur.

Amine-containing resins, when kept in the free-base form, tend to liberate very small amounts of amino compounds with a characteristic amine-type odour, for example ammonia which is particularly undesirable. This can be overcome by treatment of the resin with a weak acid, suitably acetic acid, so as partially to neutralise the amine. Alternatively, a solid acid, such as citric, tartaric or sulphonic acid, or a strongly acidic ion-exchange resin may be added to prevent the release of ammonia. An admixture of carbon would also remove released ammonia.

The filter resin may be used in tobacco smoke filters in a variety of ways, for example:

a. dispersed uniformly throughout a conventional filamentary or fibrous filtering material, for instance a cellulose acetate tow, with a cellulose-acetate filter section at the mouth end to form a "dual" filter, b. as a bed of granular or bead particles interposed and held between two filamentary or fibrous sections, which may be of cellulose acetate and/or paper or may be composite, to form a "triple" filter, c. as finely ground material spread on paper or cellulose acetate with a cellulose-acetate section at the mouth end, d. incorporated in cavities in web filter material or spread on other kinds of filter substrate.

In any of the above cases, additives such, for example, as the solid acids, added resin or carbon referred to above, as well as flavours and suitable known selective filter additives may be mixed with the filter resin.

The use of the resin in particulate form is convenient for handling in filter manufacture. Larger particle sizes, beads, are more convenient for handling, whereas the filtration efficiency of smaller particles is higher. A suitable range of sizes for practical purposes is from 100–1700 micron, preferably up to 370 micron.

The particulate resin has an equilibrium moisture content of from 10–15% which is favourable for handling during filter manufacture. Under conditions of cigarette storage, the moisture content will be suitable for obtaining good filtration efficiency. At very high moisture contents, say 50–60%, the efficiency is still good, but the particles will not flow readily, which is unsatisfactory for filter manufacture. In any case, the resin will lose moisture in time and reach the equilibrium content. If it were used at very low moisture content, the filtration efficiency would be relatively poor. A moisture content in the range of 5 to 40% is desirable. The quantity of resin required will depend on the type of filter and filtration efficiencies required and may range from 10 to 200 mg, generally 20 to 100 mg, per cigarette filter.

The following Examples illustrate modes of application of the invention and the performance achieved in the filtration of volatile constituents of tobacco smoke.

The macroporous anion-exchange resin used in the Examples, hereinafter referred to as the P.A. (primary amine) resin, was supplied by Bayer A.G. It is polystyrene crosslinked with divinyl benzene and contains substantially primary amino groups only, definable as having a nitrogen content of 9 to 11% by weight, the residual content of chloromethyl group being definable as less than 1% of chlorine by weight. The P.A. resin has a surface area of 35–50 $m^2/g$ and high porosity. It may be produced in the manner disclosed in the aforesaid German Specification except that the chloromethyl groups are substituted with ammonia only, not with other amines, and so as to leave a residue of chloromethyl group less than the limit just referred to.

Of polyvinyl monomers listed in the German Specification, the following would not be considered to be suitable for use in cigarette filters: divinylsulphone, divinylsulphide, diallylsilicate and 1,3,5-triacryloylhexanhydro-s-triazine. Of olefinic monomers mentioned, the use of vinylchloride, vinylidenechloride, methacryl compounds, acrylnitrile, butadiene, chloroprene, 2,3-dimethyl-butadiene, 2,5-dimethylhexadiene and 2,5-dimethyl-octadiene would not be used.

In all of the Examples, except Example 4, the performance or efficiency was evaluated by determining the reduction achieved in the delivery of total volatile aldehydes in the tobacco smoke.

EXAMPLE 1

The filtration efficiencies for total volatile aldehydes were determined using filters containing various weights (excluding moisture content) of the P.A. resin. For some of the tests, half of the base capacity of the resin was neutralised with acetic acid prior to preparation of the filters, using three milli-equivalents of acetic acid per gramme of resin on a dry weight basis. Each filter consisted of a bed of the resin interposed between two cellulose-acetate filter sections each 5 mm long. Cigarettes were smoked through each filter under standard conditions of one puff per minute of 35 ml volume and 2 second duration and to a butt length of 8 mm tobacco plus the length of filter. The weights of total volatile aldehydes delivered from the cigarettes with the filtration efficiencies calculated. The results are tabulated below:

| Weight of Resin (mg) | Filtration efficiency % |
|---|---|
| Free-base Resin | |
| 50 | 30 |
| 100 | 48 |
| 150 | 60 |
| Half-neutralised Resin | |
| 30 | 34 |
| 50 | 45 |
| 80 | 61 |
| 100 | 67 |
| 150 | 79 |

EXAMPLE 2

To illustrate the effect of the type of amine groups present on the filtration efficiency, a filter containing 100 mg (excluding moisture content) of the P.A. resin was compared with filters containing other resins commercially available, namely one resin with no amino group and others containing other types of amino groups. Cigarettes were smoked through the filters as in Example 1 with the following results:

| Main Functional Groups | Filtration efficiency % |
|---|---|
| None | <10 |
| Free Base Resins | |
| Tertiary Amino | 23 |
| | 26 |
| Quaternary Ammonium | 14 |
| | <10 |
| Primary, Secondary & Tertiary Amino | 50 |

-continued

| Main Functional Groups | Filtration efficiency % |
|---|---|
| Primary Amino | 67 |
| Half Neutralised Resins | |
| Tertiary Amino | 13 |
| | 21 |
| Quaternary Ammonium | 12 |
| | 13 |
| Primary, Secondary & Tertiary Amino | 51 |
| Primary Amino | 59 |

The P.A. resin containing primary amino groups only is most effective for the removal of total volatile aldehydes from tobacco smoke. The resins which contain secondary amino groups in addition to primary amino groups also have useful properties, but the resins containing tertiary amino and/or quaternary ammonium compounds are of little value.

EXAMPLE 3

The filtration efficiency for total volatile aldehydes was determined on a puff by puff basis on cigarettes with filters containing a granular bed of 100 mg of (a) the P.A. resin, (b) a commercially available resin containing secondary and tertiary groups, both resins being half-neutralised, and (c) activated carbon. The filter cigarettes were smoked under standard conditions as in Example 1.

| Puff Number | Filtration Efficiency % | | |
|---|---|---|---|
| | P.A. Resin (a) | Resin (b) | Activated Carbon (c) |
| 1 | 74 | 63 | 85 |
| 2 | 70 | 65 | 87 |
| 3 | 64 | 61 | 87 |
| 4 | 62 | 61 | 82 |
| 5 | 61 | 48 | 78 |
| 6 | 57 | 52 | 77 |
| 7 | 55 | 47 | 75 |
| 8 | 54 | 47 | 68 |
| 9 | 52 | 37 | 56 |
| 10 | 50 | 26 | 26 |
| 11 | — | 19 | 9 |
| Total | 59 | 45 | 62 |

The carbon used in this example was grade MF3 supplied by Chemviron Ltd. All three materials reduce the per-puff deliveries of total volatile aldehydes, but the P.A. resin remains highly active considerably longer than the carbon or the resin (b) during the smoking of the cigarettes.

EXAMPLE 4

The retentions of individual vapour-phase constituents by a filter containing a bed of 100 mg of P.A. resin (excluding moisture content) half neutralised with acid as in Example 1 were determined:

| Smoke Constituent | Peak Number | Filtration Efficiency % Half Neutralised P.A. Resin |
|---|---|---|
| Menthane | 1 | <10 |
| Ethylene* | 2 | <10 |
| Ethane | 3 | <10 |

-continued

| Smoke Constituent | Peak Number | Filtration Efficiency % Half Neutralised P.A. Resin |
|---|---|---|
| Propylene | 4 | <10 |
| Propane | 5 | <10 |
| Methyl Chloride* | 6 | 10 |
| Acetaldehyde | 7 | 66 |
| Iso-butane | 8 | <10 |
| I-Butene* | 9 | <10 |
| n-Butene | 10 | <10 |
| Cis-2-Butene | 11 | <10 |
| Acetonitrile | 12 | 13 |
| Acrolein/Propional dehyde/ Acetone* | 13 | 19 |
| 2-Methyl Butene* | 14 | <10 |
| Isoprene* | 15 | <10 |
| Trans 1,3-Pentadiene* | 16 | <10 |
| Propionitrile | 17 | 13 |
| Methacrolein* | 18 | 39 |
| Methyl Ethyl Ketone* | 19 | 14 |
| Trimethylacetaldehyde* | 20 | <10 |
| n-Hexane* | 21 | 14 |
| Benzene* | 22 | <10 |
| Iso-Valeraldehyde | 23 | 48 |
| 2-Pentanone* | 24 | 11 |
| Toluene | 25 | <10 |

*Contain small quantities of other compounds.

The highly selective effect with respect to the aldehydes is evident.

EXAMPLE 5

A number of cigarettes were smoked through a single filter containing 100 mg of the P.A. resin (half neutralised with acetic acid) and a filter containing 100 mg of the aforesaid resin (b). To prevent blocking by total particulate matter (T.P.M.) and consequent breakdown of the filter, a Cambridge filter pad (a filter which removes all the T.P.M.) was interposed between each filter and the tobacco rod.

| | Filtration Efficiency % | |
|---|---|---|
| Cigarette | P.A. Resin | Resin (b) |
| 1st | 79 | 73 |
| 2nd | 77 | 65 |
| 3rd | 77 | 59 |
| 4th | 72 | 57 |
| 5th | 70 | 52 |
| 6th | 67 | 52 |
| 7th | 69 | 52 |
| 8th | 63 | 44 |
| 9th | 64 | 48 |
| 10th | 60 | 45 |

It will be seen from this table that both the P.A. resin and resin (b) have a high capacity for removing volatile aldehydes, but that the P.A. resin has a higher, sustained, capacity.

EXAMPLE 6

To investigate the suppression of undesirable ammoniacal odours from the free-base P.A. resin, it was mixed intimately with: (a) an acid ion-exchange resin containing sulphonic acid groups, (b) crystalline citric acid, and (c) a granular carbon (that used in Example 3). When a stream of nitrogen was passed through a column of each mixture, the emerging gas was neutral, showing that no ammoniacal vapours were being released. Filters, each with a bed of 100 mg of a respective mixture between two cellulose acetate sections, were attached to tobacco rods and smoked as in Example 1.

| | Filtration Efficiency % | Weight of Resin (mg) |
|---|---|---|
| Resin + acid resin | 44 | 83 |
| Resin + citric acid | 58 | 91 |
| Resin + carbon | 67 | 50 |
| Resin | 49 | 83 |

No ammoniacal odour was observed on smoking cigarettes through these filters.

EXAMPLE 7

To ascertain whether the amine odour can be removed by using mixed granular beds of P.A. resin and acid resin or solid acid without adversely affecting the filtration efficiency, filters were prepared, as in Example 6, in which (i) all the free-base P.A. resin is at the tobacco end and (ii) all the free-base P.A. resin is next to the mouth end of a dual filter. No amine odour was observed on smoking cigarettes through these filters. Similar filters were also attached to tobacco rods and smoked as in Example 1. In all cases, filtration efficiencies for volatile aldehydes, similar to those of filters containing the same weight of free-base P.A. resin alone, were achieved as shown by the table below. The presence of the acid resin or solid acid does not reduce the efficiency.

| Mixture | Filtration Efficiency % Experimental | Filtration Efficiency % Expected | Weight of Resin (mg) |
|---|---|---|---|
| P.A. resin at tobacco end and acid resin at mouth end | 54 | 49 | 83 |
| P.A. resin at mouth end and acid resin at tobacco end | 50 | 49 | 83 |
| P.A. resin at tobacco end and citric acid at mouth end | 61 | 53 | 91 |
| P.A. resin at mouth end and citric acid at tobacco end | 60 | 53 | 91 |

EXAMPLE 8

Different lengths of cellulose acetate tow (3.5/37,000 denier) were sprayed with a plasticiser (triacetin), to give a 10% loading by weight. The plasticised tow was evenly sprinkled with half-neutralised P.A. resin. The tow was gathered together, and made into a filter rod from which 18 mm long section were cut and, together with 7 mm long cellulose-acetate sections, made into dual filters. Cigarettes were smoked through the filters as in Example 1.

| Weight of Resin (mg) in tow | Filtration Efficiency % |
|---|---|
| 11 | 26 |
| 23 | 28 |
| 34 | 30 |
| 46 | 36 |

Even a low loading of the P.A. resin dispersed on plasticised cellulose-acetate tow reduces the delivery of total volatile aldehydes.

EXAMPLE 9

Half-neutralised P.A. resin was ground and separated by sieving into different particle size ranges. Filters of 20 mm length containing 22 mg (excluding moisture) of the resin of each particle size, were prepared as described in Example 8. Cigarettes were smoked through the filters as in Example 1.

| Particle Size Range micron | Filtration Efficiency % |
|---|---|
| 355–300 | 10 |
| 300–212 | 14 |
| 212–150 | 24 |
| 150–105 | 31 |
| 105 | 36 |

The smaller the particle size, the greater is the retention of volatile aldehydes by the filter.

EXAMPLE 10

Half-neutralised P.A. resin was ground in a ball mill to a very fine powder which was sieved to give a particle size smaller than 105 micron. A slurry was prepared by mixing the sieved powder with water and was sprayed onto cellulose-acetate tow (3.5/37,000 denier) and onto paper tissue to give a loading of 11 mg of P.A. resin (excluding moisture content) per filter section of 10 mm length. Triple filters were made comprising such a resin/paper section or a resin/cellulose-acid section interposed between a section of untreated filter paper and a section (at the mouthpiece end) of cellulose acetate. Cigarettes provided with these triple filters were smoked as in Example 1.

| | Puff by puff filtration efficiencies | |
|---|---|---|
| | Filtration Efficiencies % | |
| Puff Number | Triple filters containing Paper + Resin | Triple filters containing Cellulose Acetate + Resin |
| 1 | 35 | 38 |
| 2 | 40 | 43 |
| 3 | 25 | 37 |
| 4 | 20 | 35 |
| 5 | 37 | 36 |
| 6 | 28 | 37 |
| 7 | 20 | 31 |
| 8 | 29 | 38 |
| 9 | 35 | 33 |
| 10 | 34 | 29 |
| Overall | 30 | 34 |

The table shows that the performance of even a small amount of the P.A. resin used in finely divided form does not seriously decline during smoking.

EXAMPLE 11

The effect of moisture content on filtration efficiency for volatile aldehydes was determined on samples of the P.A. resin which had different moisture contents. Granular bed filters each containing 100 mg by dry weight of resin were prepared, attached to tobacco rods and smoked as described in Example 1.

| Moisture Content % | Filtration Efficiency % |
|---|---|
| Free-base Resin | |
| 2 | 50 |
| 12 | 60 |
| 57 | 67 |
| Half-neutralised Resin | |
| 1 | 29 |
| 12 | 48 |
| 63 | 48 |

The filtration efficiency is significantly reduced at low moisture contents.

We claim:

1. A tobacco-smoke filter containing, as adsorbent for volatile tobacco-smoke constituents, a particulate macroporous amine-type anion-exchange resin which contains substantially primary amino groups only.

2. A filter according to claim 1, wherein the resin is a cross-linked polyvinyl aromatic compound.

3. A filter according to claim 1, wherein the resin is a polystyrene cross-linked with divinyl benzene.

4. A filter according to claim 1, wherein the resin is in particulate form within a size range of 100 to 1700 micron.

5. A filter according to claim 1, wherein the resin is present in an amount between 10 and 200 mg per cigarette filter.

6. A filter according to claim 1, wherein the resin has been partially neutralised with acetic acid.

7. A filter according to claim 1, wherein the resin is in particulate form and is accommodated between filter sections of the group consisting of fibrous, filamentary and paper filter sections.

8. A filter according to claim 1, wherein the resin is in particulate form and is dispersed in a tow.

9. A filter according to claim 1, wherein the resin has a moisture content between 5 and 40%.

10. The tobacco-smoke filter of claim 1 wherein said filter also contains, in admixture with said resin, a solid acid.

11. A tobacco-smoke filter containing between about 9 mg and 200 mg of a particulate macroporous amine-type anion exchange resin, said resin having a size within the range of between about 100 to 1,700 microns and comprising a cross-linked polyvinyl aromatic compound containing substantially primary amine groups only.

12. The filter of claim 11 in which said resin is polystyrene cross-linked with divinylbenzene having a nitrogen content of about 9% to about 11% by weight and a surface area of about 35 to about 50 square meters per gram.

* * * * *

UNITED STATES PATENT OFFICE

CERTIFICATE OF CORRECTION

Patent No. 4,033,361 Dated July 5, 1977

Inventor(s) Henry George Horsewell, Ian Richard Harris

It is certified that error appears in the above-identified patent and that said Letters Patent are hereby corrected as shown below:

Column 6, line 53, "section" should be --sections--.

Column 8, line 48, "9" should be --10--.

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademarks*